United States Patent [19]

Parker

[11] Patent Number: 4,843,998

[45] Date of Patent: Jul. 4, 1989

[54] SUBMERSIBLE DRIVE MEANS

[76] Inventor: David Parker, R.D. 1 Box 238, Cobleskill, N.Y. 12023

[21] Appl. No.: 131,210

[22] Filed: Dec. 11, 1987

[51] Int. Cl.[4] ..... B63C 11/02

[52] U.S. Cl. ..... 114/315; 440/6; 440/87; 200/293.1

[58] Field of Search ..... 114/315, 338; 440/6, 440/84, 87; 200/157, DIG. 2; 405/185, 186, 187

[56] References Cited

U.S. PATENT DOCUMENTS

| | | | |
|---|---|---|---|
| 2,722,021 | 11/1955 | Keogh-Dwyer | 114/315 |
| 3,329,118 | 7/1967 | Strader | 114/315 |
| 3,415,211 | 12/1968 | Hampton | 114/315 |
| 3,422,787 | 1/1969 | Rush | 440/6 |
| 3,441,952 | 4/1969 | Strader | 440/6 |
| 3,635,188 | 1/1972 | Rutkowski | 440/6 |
| 3,700,836 | 10/1972 | Rackson | 200/157 |
| 3,757,721 | 9/1973 | Ohishi | 114/338 |
| 3,916,814 | 11/1975 | Bardoni et al. | 114/315 |
| 3,995,578 | 12/1976 | McCullough | 440/6 |
| 4,220,110 | 9/1980 | Roberson, Jr. et al. | 114/315 |
| 4,231,310 | 11/1980 | Muramatsu | 200/157 |
| 4,467,742 | 8/1984 | Duboy | 114/315 |
| 4,491,325 | 1/1985 | Bersheim | 200/DIG. 2 |
| 4,517,424 | 5/1985 | Kroczynski | 200/157 |
| 4,700,654 | 10/1987 | Borges | 114/338 |
| 4,722,625 | 2/1988 | O'Brien | 200/157 |
| 4,753,187 | 6/1988 | Galimand | 114/315 |

*Primary Examiner*—Sherman D. Basinger
*Assistant Examiner*—Thomas J. Brahan
*Attorney, Agent, or Firm*—Schmeiser, Morelle & Watts

[57] ABSTRACT

A submersible drive unit for propelling a scuba diver through water. The propulsion device comprises a shrouded propeller which is removably and adjustably attached to the diver's air tank. Removably attached to the propeller shroud is a waterproof motor housing for encasing a motor to drive the propeller. Batteries for driving the motor are enclosed within two kidney-shaped cases, one located on each side of a conventional diver's weight belt. A hand grip having at least one switch is used to activate/deactivate the unit as well as to control the speed.

6 Claims, 2 Drawing Sheets

FIG. 4
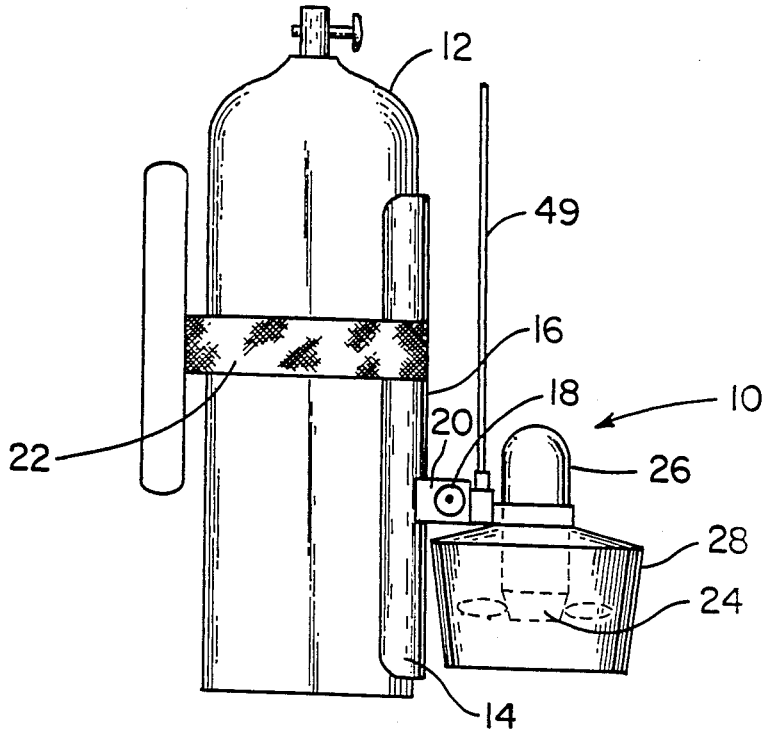
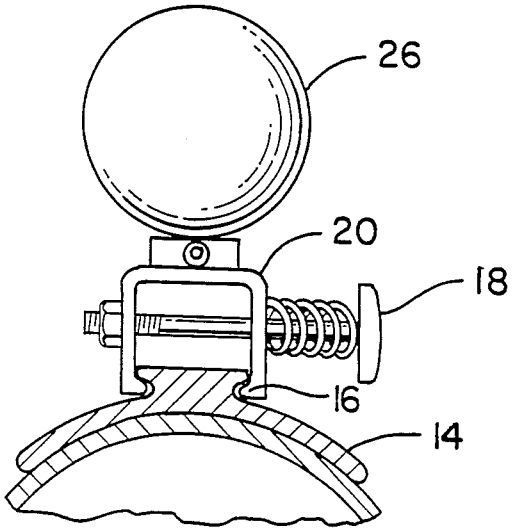
FIG. 5

SUBMERSIBLE DRIVE MEANS

FIELD OF THE INVENTION

The present invention relates generally to propulsion devices and, more particularly, to submersible drive means for propelling a scuba diver through water.

BACKGROUND OF THE INVENTION

To do underwater research or sightseeing, the physical exertion required to swim tires the swimmer and inhibits the ability of the swimmer to remain submersed for extended periods of time. This is due mainly to the additional oxygen needed by a person engaged in a rigorous physical activity, such as swimming. Prior art devices used to preserve one's strength, thereby increasing one's endurance, include propulsion units mounted on boats or sleds. There are many limitations inherent in the aforementioned prior art devices, not the least of which is the inability of the swimmer to use his hands for any task other than to control the propulsion device.

Propulsion units which give the swimmer freedom to use his hands have been developed. One such device disclosed in the patent issued to Keogh-Dwyer, U.S. Pat. No. 2,722,021, is a mechanical power propulsion device to be secured across the chest or back of the user. A bracelet incorporates a control comprising an on/off switch and a dual speed switch. Another prior art device which allows freedom of hand movement is disclosed in the Strader patent, U.S. Pat. No. 3,329,118. Strader invented a propulsion unit having a harness to secure same to the user and further having hand controls attached to the harness.

Despite the convenience in having free hands afforded by the aforementioned patents, the user is still limited by the bulkiness and heaviness of these units leading to the need for buoyancy control means. For example, the aforementioned patent issued to Strader includes a ballast chamber and valves to adjust the buoyancy of the unit. Likewise, the Keogh-Dwyer patent discloses a buoyancy control compartment and control valves. Still another method of buoyancy control well-known in the prior art is the use of weight belts; that is, weights are added or subtracted, as needed, from a belt worn by the user until zero buoyancy is achieved. The additional elements required by any of the aforesaid buoyancy control methods add further to the bulkiness of the units and thus detract from the efficiency of the prior art devices.

More streamlined propulsion units were developed by Bardoni and McCullogh, their inventions being disclosed in U.S. Pat. No. 3,916,814 and U.S. Pat. No. 3,995,578, respectively. Disadvantageously, the power supply and propulsion unit of these prior art inventions comprise unitary devices, thus limiting the versatility and balance of the propulsion assemblies.

Scuba diving creates a type of weightless condition for the diver. Similar to weightlessness experienced, for example in outer space, only a slight force can disrupt the equilibrium of the weightless condition. However, the equilibrium of the scuba diver is in some ways more sensitive due to the need to balance the forces of gravity and bouyancy. If a diver's weight belt is one or two pounds too light, the diver may not be able to submerge, or, may have to exert a great deal of energy swimming down to a depth where compression reduces bouyancy sufficiently to achieve the virtually weightless condition. In achieving proper bouyancy, balance is also vitally important. Any diver who, finding himself a few pounds short for submersion, decides to place an extra pound or two in the pocket of the bouyancy compensator vest will explain how most of the dive was spent trying to prevent rotation caused by unbalanced weight distribution. Similarly, propulsion devices of the prior art have failed to properly allow for even weight distribution. Units placed entirely on the diver's back will cause a loss of balance should the diver attempt to achieve a stationary upright position such as kneeling or standing. Other units, though placed differently, do not allow for sufficient versatility to obtain easy and accurate balance.

Submersible drive means capable of propelling a person underwater, which is streamlined, yet versatile, is desired. Such a device should be easily controllable and generally provide a convenient, efficient method for underwater travel. Additionally, safety features should be incorporated in case of external dangers or internal malfunction.

SUMMARY OF THE INVENTION

The present invention is a submersible drive means for propelling a person underwater. A motor and propeller assembly is removably attachable to a scuba diver's air tank. The propeller is shrouded to provide a more streamlined unit, thereby increasing its efficiency.

The power source for driving the motor is movably mounted on a belt to be worn around the waist of the diver. Particularly, movably mounted on each side of the belt, a battery case is provided for the series connection of batteries therein. Within the belt, conductors are provided for the electrical connection of the batteries within the two cases. Additionally, a quick release mechanism having dual functions is included; the quick release not only removes the belt from the diver, but also disengages the power supply, thereby providing safety means upon release of the belt.

To activate the propulsion unit and to control the speed, a motor control mechanism is attachable to a wrist-band to be worn by the diver. On the wrist-band, a hand grip with switch means is easily accessible to the diver. Hinge means are provided for maintaining the hand grip in close proximity to the diver's hand without restricting hand and arm movement.

The major advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, combinations and improvements herein shown and described.

The accompanying drawings referred to herein and constituting a part hereof illustrate preferred embodiments of the invention and together with the description, serve to explain principles of the invention.

BRIEF DESCRIPTION OF THE DRAWINGS

Of the drawings:

FIG. 4 is a side elevation of the submersible drive means of the present invention attached to a scuba diver's air tank; and FIG. 5 is a top fragmentary view of the present invention as shown in FIG. 4.

DETAILED DESCRIPTION OF THE DRAWINGS

Figure 1:
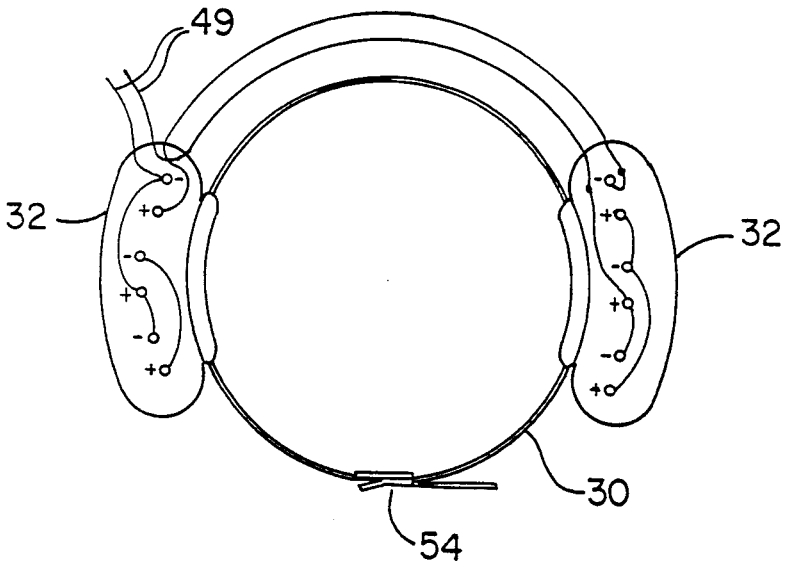
FIG. 1 is a top plan view of the scuba diver's belt.

With reference to FIG. 4, the propulsion unit of the submersible drive means of the present invention, generally designated by the numeral 10, is shown removably attached to a scuba diver's air tank 12.

The propulsion unit is removably mounted to the airtank 12 by bracket 14. In the preferred embodiment, the bracket 14 is made of a light metal, such as aluminum, but any suitable material may be used. A dovetail slide track 16 is provided on the aluminum bracket 14 for adjustable mounting thereon. In this way, the propulsion unit 10 may be secured at any position along the airtank 12 by tightening the locking screw 18 into mounting bracket 20, thus enabling a method of buoyancy control. The aluminum bracket 14 is attached to the airtank 12 by the strap 22 of a conventional backpack or buoyancy compensator which is worn by the scuba diver.

In general, the propulsion unit 10 comprises a propeller 24 and a motor encased within a waterproof motor housing 26. The motor of the preferred embodiment is a twelve volt, variable speed, DC motor. The propeller 24 is enclosed within a shroud 28 in order to improve the efficiency of the unit 10 and to provide safety. In the preferred embodiment, the propeller shroud 28 is plastic, but any suitable, waterproof material may be used. Shroud 28 has an extruded base on which the motor housing 26 is removably mounted.

Figure 2:
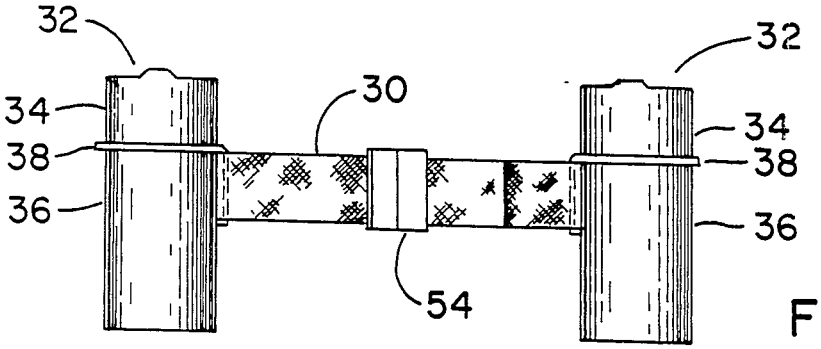
FIG. 2 is a side elevation of the scuba diver's belt of FIG. 1.

Referring to FIGS. 1 and 2, the power supply for the motor is located on belt 30 to be worn by the scuba diver. In one embodiment, the belt 30 may be a conventional scuba diver's weight belt, for further buoyancy control. At the hip portions of the belt 30, two kidney shaped battery cases 32 are movably attached. In the preferred embodiment of the present invention, the battery cases 32 are made of molded plastic shaped so as to conform to the contours of the body of a scuba diver and to slide onto a conventional weight belt. The cases 32 each comprise a lid 34 and an attached base portion 36. The two-part configuration is employed so that external means for recharging the batteries may be easily and conveniently used. An O-ring seal 38 is used to maintain the watertight condition of the battery cases 32. Within each battery case 32, three two volt batteries are wired in series. Alternatively, a parallel combination of batteries could be used. In the lid 34 of each case 32, orifices are provided to receive conductors 49 which fit tightly therein. The conductors 49 electrically wire the motor of the propulsion unit 10 to the power supply. In FIG. 1 and in accordance with the preferred embodiment, a top plan view of the scuba diver's belt 30 shows the series wiring of the batteries in the two cases 32 with the battery terminals shown with polarities marked for illustration. Conductors 49 extend from the belt 30 and are connected to the motor as shown in FIG. 4 in order to complete the power supply circuit.

When recharging the batteries, the positive recharging lead will be within one battery case 32 and the negative recharging lead will be within the other battery case 32. This assures that both O-rings will be disengaged and each case 32 will be opened for recharging, thus guaranteeing proper ventilation and avoiding explosions.

In an alternate embodiment of the present invention, floatation means for maintaining a power supply above the surface of the water is used. The power supply in this embodiment is tethered to the scuba diver's air tank, being attached to the strap 22 by additional strap means (not shown).

Figure 3:
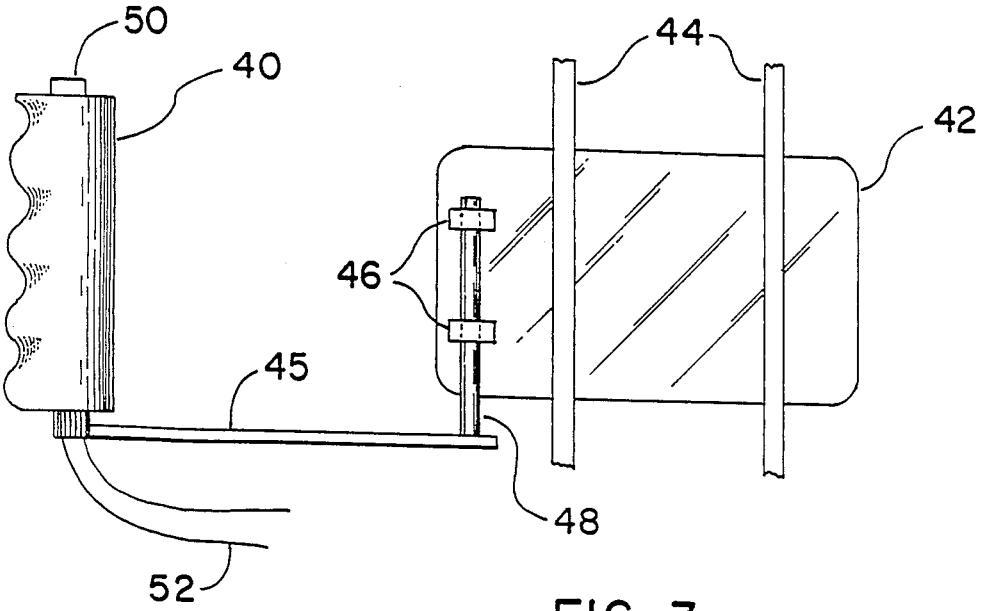
FIG. 3 is a plan view of the hand control and wrist-band to be worn by the scuba diver.

The present invention includes hand control means for activating and deactivating the propulsion unit 10 and, additionally, for controlling the propeller speed. Referring now to FIG. 3, the hand control means comprises a hand grip 40 and a wrist-band 42 to be worn by the scuba diver. Straps 44 are secured to the diver's wrist by tying or other suitable means. The hand grip 40 is connected to the wrist-band 42 by rod 45. Hinge means comprising hinges 46 with bar 48 extending therethrough are provided to enable the scuba diver who releases the hand grip 40 to have freedom of hand movement in the area immediately surrounding the diver's hand. Advantageously, upon release of the hand grip 40, the hinges 46 cause it to swing out of the way of the diver's hand, while still maintaining it in close proximity to the diver's hand for easy accessibility.

A switched contact, variable resister type push-button switch 50 is provided on the hand grip 40. By depressing the switch 50, the propulsion unit 10 is activated. As the finger pressure on the switch 50 is increased, the motor speed increases. Upon release of the switch 50, the power supply is shut off; thus the propulsion unit 10 is deactivated. Conductor 52 electrically connects switch 50 to the power supply in the belt 30.

In an alternate embodiment of the present invention, two switches are used. The first switch is the on/off switch. The second switch is a double pull, double throw switch for speed control. In this embodiment, a third switch may be employed. In particular, a contact on, no-contact off switch which switches off upon release of the hand grip 40 would function as a safety feature. That is, if the diver were to drop the hand grip 40, the propulsion unit would be automatically deactivated.

As a safety feature, upon opening the belt buckle 54 and dropping the weight belt, the power supply is immediately unpluged from the motor. This quick-disconnect means is incorporated to be activated by belt buckle release for easy access and due to the fact that all certified divers are instructed in properly attaching a weight belt for quick release in some emergency situations. Of course, in an alternate embodiment, one could run the conductors 49 through a junction at the belt buckle 54 thereby breaking the circuit and disconnecting the power supply immediately upon disengaging the buckle.

What is claimed is:

1. Submersible drive means for propelling a scuba diver through water, comprising:

a propeller enclosed within a shroud, said shroud being removably and adjustably attachable to the air tank of a scuba diver;

a motor for driving said propeller, said motor being encased within a waterproof motor housing which is removably attachable to said propeller shroud;

a power supply adapted to be attached to a weight belt, and means to connect said power supply to said motor;

hand control means for activating and deactivating the submersible drive means and for controlling the speed thereof;

means for disengaging the power supply from said motor upon release of the weight belts; and two separate water proof battery cases for receiving a plurality of batteries, said battery cases adapted to be located on each side of the hip portions of said belt, and means for electrically wiring the batteries within said battery cases together, each battery case having at least two parts joined together with watertight seal, one battery case containing a positive recharging lead and the other battery case containing a negative recharging lead, said recharging leads being within the battery case whereby the watertight seal must be disengaged and said cases must be opened for access to said recharging leads.

2. The invention of claim 1 wherein the hand control means further comprises a wrist-band for securing the hand control means to the diver.

3. The invention of claim 2 wherein said hand control means comprises a switched contact, variable resistor type push-button switch incorporated into a hand grip, whereby the amount of finger pressure on said push-button switch determines the speed of said propeller.

4. The invention of claim 2 wherein said hand control means comprises a double pull, double throw switch incorporated into a hand grip, whereby said double pull, double throw switch may be moved alternatively between a first position and a second position.

5. The invention of claim 4 wherein the submersible drive means is capable of being driven at a low speed or a high speed depending on the position of said double pull, double throw switch.

6. Submersible drive means for propelling a scuba diver through water, comprising:

a propeller enclosed within a shroud, said shroud being removably and adjustably attachable to the air tank of a scuba diver;

a motor for driving said propeller, said motor being encased within a waterproof motor housing which is removably attachable to said propeller shroud;

a power supply adapted to be attached to a weight belt, and means to connect said power supply to said motor;

hand control means for activating and deactivating the submersible drive means and for controlling the speed thereof;

means for disengaging the power supply from said motor upon release of the weight belts;

two separate water proof battery cases for receiving a plurality of batteries, said battery cases adapted to be located on each side of the hip portions of said belt, and means for electrically wiring the batteries within said battery cases together, one battery case containing a positive recharging lead and the other battery case containing a negative recharging lead, said recharging leads being within the battery case whereby said cases must be open for access to said recharging leads;

a wrist band for securing the hand control means to the diver; and hinge means for removing said hand control means from the immediate area surrounding the scuba diver's hand upon release thereof, thereby allowing the scuba diver room to maneuver.

* * * * *